US008052457B2

(12) United States Patent
Miyazaki et al.

(10) Patent No.: US 8,052,457 B2
(45) Date of Patent: Nov. 8, 2011

(54) CONNECTOR WITH LOCK MECHANISM

(75) Inventors: Yoji Miyazaki, Tsu (JP); Kenji Okura, Tsu (JP)

(73) Assignee: Panasonic Electric Works Co., Ltd., Osaka (JP)

( * ) Notice: Subject to any disclaimer, the term of this patent is extended or adjusted under 35 U.S.C. 154(b) by 0 days.

(21) Appl. No.: 12/659,785

(22) Filed: Mar. 22, 2010

(65) Prior Publication Data

US 2010/0248524 A1 Sep. 30, 2010

(30) Foreign Application Priority Data

Mar. 24, 2009 (JP) ..... 2009-071198

(51) Int. Cl.
*H01R 13/627* (2006.01)

(52) U.S. Cl. ..... 439/357

(58) Field of Classification Search ..... 439/357, 439/74; 13/627
See application file for complete search history.

(56) References Cited

U.S. PATENT DOCUMENTS

| | | | | |
|---|---|---|---|---|
| 5,975,916 | A * | 11/1999 | Okura | 439/74 |
| 6,799,979 | B1 * | 10/2004 | Huang | 439/74 |
| 6,986,670 | B2 * | 1/2006 | Okura et al. | 439/74 |
| 7,112,091 | B2 * | 9/2006 | Okura et al. | 439/570 |
| D539,225 | S * | 3/2007 | Kishi et al. | D13/147 |
| D540,263 | S * | 4/2007 | Kishi et al. | D13/147 |
| 7,278,861 | B2 * | 10/2007 | Kishi et al. | 439/74 |
| 7,410,364 | B2 * | 8/2008 | Kishi et al. | 439/74 |
| 7,465,171 | B2 * | 12/2008 | Miyazaki et al. | 439/74 |
| 7,658,636 | B2 * | 2/2010 | Takeuchi et al. | 439/357 |
| 7,717,719 | B2 * | 5/2010 | Miyazaki et al. | 439/74 |
| 7,722,408 | B2 * | 5/2010 | Miyazaki et al. | 439/660 |
| 2001/0049220 | A1 * | 12/2001 | Kodama | 439/357 |
| 2002/0022394 | A1 * | 2/2002 | Fukuda | 439/357 |
| 2002/0076968 | A1 * | 6/2002 | Kamata et al. | 439/357 |
| 2002/0142643 | A1 * | 10/2002 | Quinn et al. | 439/357 |
| 2002/0155747 | A1 * | 10/2002 | Groebe et al. | 439/357 |
| 2003/0008546 | A1 * | 1/2003 | Nagamine et al. | 439/357 |
| 2003/0017739 | A1 * | 1/2003 | Sawayanagi | 439/357 |
| 2004/0014335 | A1 * | 1/2004 | Igarashi et al. | 439/74 |
| 2004/0029428 | A1 * | 2/2004 | Wu | 439/357 |
| 2005/0075002 | A1 * | 4/2005 | Kubo et al. | 439/357 |
| 2005/0124202 | A1 * | 6/2005 | Roese | 439/357 |
| 2005/0191891 | A1 * | 9/2005 | Khoury | 439/357 |
| 2008/0207014 | A1 * | 8/2008 | Takeuchi et al. | 439/74 |
| 2010/0173514 | A1 * | 7/2010 | Chiang et al. | 439/357 |

OTHER PUBLICATIONS

Korean Official Action in corresponding Korean Application 10-2010-0026420, dated Jul. 20, 2011, and English summary thereof.

* cited by examiner

*Primary Examiner* — Tulsidas C Patel
*Assistant Examiner* — Vladimir Imas
(74) *Attorney, Agent, or Firm* — Bacon & Thomas, PLLC

(57) ABSTRACT

A connector includes a generally rectangular socket and a generally rectangular header couplable with the socket. The header is provided with arch-shaped engaging members arranged in opposite short sides thereof, the engaging members being elastically deformable in the longitudinal direction of the header. Each of the engaging members includes a protrusion portion protruding from the header or socket in the longitudinal direction thereof. The socket includes retainer portions engageable with the respective protrusion portions of the engaging members. The engaging members are elastically deformed when the header is coupled with the socket.

12 Claims, 7 Drawing Sheets

CONNECTOR WITH LOCK MECHANISM

FIELD OF THE INVENTION

The present invention relates to a connector provided with a lock mechanism for keeping the coupling state of a socket and a header which are coupled together and electrically connected to each other.

BACKGROUND OF THE INVENTION

In small-size devices such as a cellular phone, a digital still camera and a digital video camera, printed wiring boards are assembled together to form a desired circuit. As shown in FIG. 7, a connector 30 provided with a socket 31 and a header 32 is used in connecting the printed wiring boards to one another. The socket 31 and the header 32 are mounted to each of the printed wiring boards and are fitted together to electrically connect the printed wiring boards. The connector 30 of this kind is disclosed in Japanese Patent Application Publication No. 2006-210182.

In order to enhance the portability of the devices and to reduce the size thereof, a demand has existed for improvements of the devices. The connector 30 is one of the parts to be improved. It is however difficult to reduce the size of the connector 30, while maintaining the coupling force of the socket 31 and the header 32 and avoiding disconnection or unstable connection between the socket-side electric wiring lines and the header-side electric wiring lines.

SUMMARY OF THE INVENTION

In view of the above, the present invention provides a connector capable of realizing size reduction while keeping a socket and a header in a reliably coupled state.

In accordance with an embodiment of the present invention, there is provided a connector including a generally rectangular socket and a generally rectangular header couplable with the socket, wherein: one of the header and the socket is provided with arch-shaped engaging members arranged in opposite short sides thereof, the engaging members being elastically deformable in the longitudinal direction of the header or socket, each of the engaging members includes a protrusion portion protruding from the header or socket in the longitudinal direction thereof, the other of the header and the socket includes retainer portions engageable with the respective protrusion portions of the engaging members, and the engaging members are elastically deformed when the header is coupled with the socket.

With such configuration, even when the engaging members undergo deformation, the dimension of the engaging members remains unchanged in the direction in which the header is coupled with the socket. As a result, it is possible to reduce the size of the connector by the amount of deformation of the conventional engaging members.

Preferably, when the header is coupled with the socket, the protrusion portions of the engaging members are pressed by the retainer portions and elastically deformed inwards of the header or socket, after which the protrusion portions are restored to an original state and engaged with the retainer portions.

Preferably, the header or socket including the retainer portions has holes formed on the surface thereof opposite to the surface on which the header or socket provided with the engaging members is mounted, the holes being shaped to permit insertion of a rod-like member therethrough, and wherein when the rod-like member is inserted into the hole to press each of the protrusion portions of the engaging members, the protrusion portion is elastically deformed inwards of the header or socket to release engagement of the protrusion portion and the corresponding retainer portions.

In accordance with another embodiment of the present invention, there is provided a connector including a socket, a generally rectangular header couplable with the socket, and a lock mechanism for coupling the socket and the header together, wherein: the lock mechanism includes: arch-shaped engaging members arranged in opposite short sides of the header, the engaging members being extendible and retractable in a width direction of the header, the engaging members provided with protrusion portions whose protrusion amount from the header is increased when the engaging members are retracted but decreased when the engaging members are extended; and retainer portions provided in the socket and engageable with the respective protrusion portions of the engaging members.

With such configuration, the arch-shaped engaging members arranged in the opposite short sides of the header are elastically deformable in the longitudinal direction of the header. Therefore, even when the engaging members undergo deformation, the dimension of the engaging members remains unchanged in the direction in which the header is coupled with the socket. As a result, it is possible to reduce the size of the connector by the amount of deformation of the prior art engaging members.

Further, the engaging members are provided with protrusion portions whose protrusion amount from the header is increased when the engaging members are retracted but decreased when the engaging members are extended. The socket is provided with retainer portions engageable with the protrusion portions of the engaging members. If the header is coupled with the socket, the protrusion portions come into engagement with the retainer portions. Therefore, the protrusion portions and the retainer portions are engaged with each other and become a single unit when the header is coupled with the socket. In other words, the header can be coupled with the socket through a one-touch operation.

Preferably, when the header is coupled with the socket, each of the protrusion portions is pressed by the corresponding retainer portion so that the protrusion amount thereof is decreased, and wherein, when the header is completely coupled with the socket, each of the protrusion portions moves beyond the corresponding retainer portion so that the protrusion amount thereof is increased.

With such configuration, the protrusion portions are pressed by the retainer portions in the process of coupling the header with the socket, which reduces the amount of protrusion of the protrusion portions from the header. Therefore, no difficulty is encountered in coupling the header with the socket. If the header is completely coupled with the socket, the protrusion portions move beyond the retainer portions so that the amount of protrusion of the protrusion portions from the header can be increased. This helps prevent the header from being inadvertently removed from the socket. Accordingly, it is possible to smoothly couple the header with the socket. In addition, there is no possibility that the header is removed from the socket by an external force after they have been coupled together.

Preferably, the socket has holes formed on the surface thereof opposite to the surface on which the header is mounted, the holes of the socket being shaped to permit insertion of rod-like members therethrough, and the protrusion amount of the engaging members from the header are changed to release engagement of the protrusion portions and the retainer portions, when the rod-like members are inserted into the holes.

With such configuration, the amount of protrusion of the protrusion portions from the header can be changed by pressing the protrusion portions with the rod-like members. As a result, it is possible for the rod-like members to reduce the protrusion amount of the protrusion portions, thereby releasing engagement of the protrusion portions and the retainer portions. This makes it possible to smoothly remove the header from the socket.

In the connector of the present invention, the protrusion portions of the engaging members can be extended or retracted in the longitudinal direction of the header, which results in a change in the amount of protrusion of the protrusion portions from the header. Therefore, it is possible to reduce the dimension of the connector in the direction in which the header is coupled with the socket. This makes it possible to reduce the size of the connector. In addition, the socket and the header are coupled together in a reliable manner, which assures good electric conduction between the socket and the header.

DETAILED DESCRIPTION OF THE PREFERRED EMBODIMENTS

Figure 1:
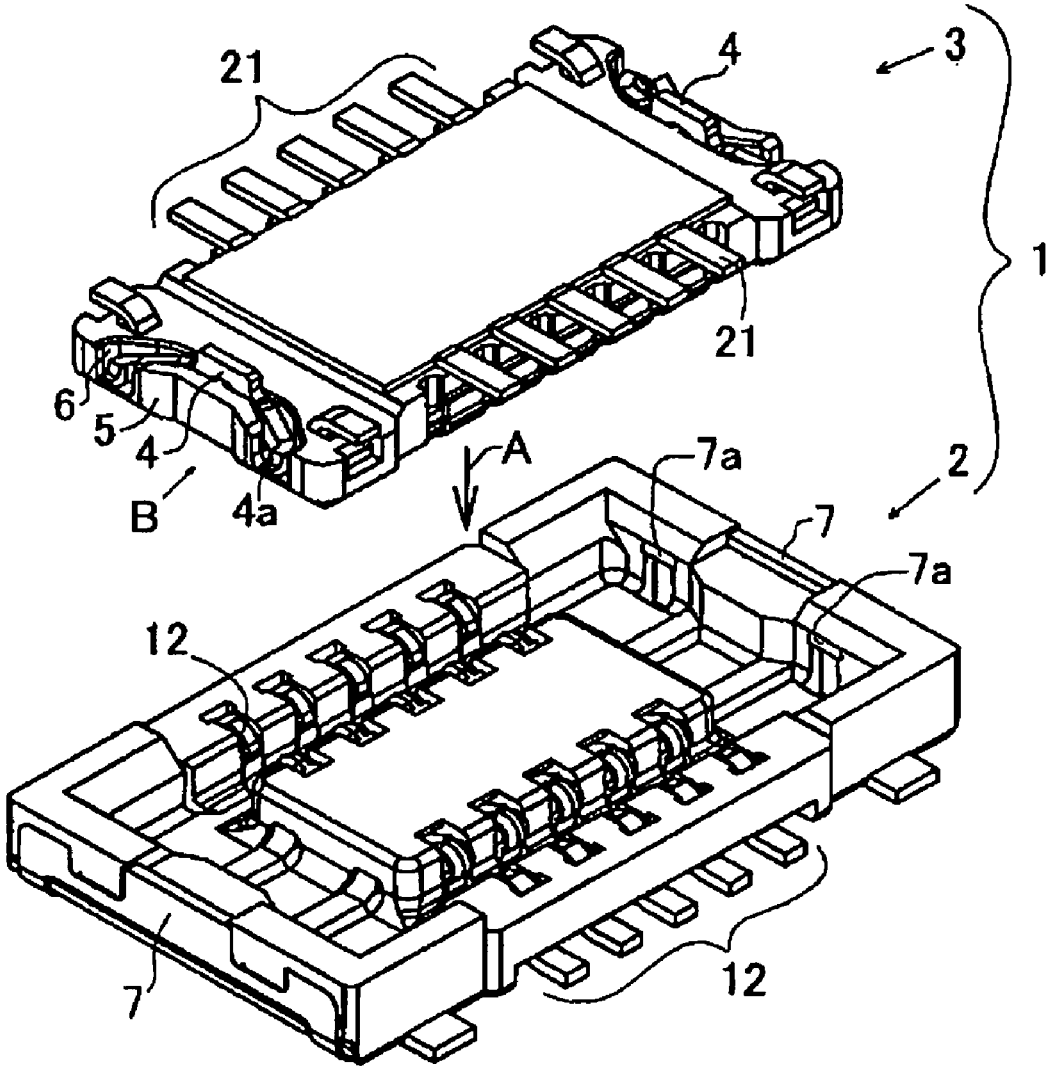
FIG. 1 is an exploded perspective view showing the present connector provided with a socket and a header.
Figure 2A:
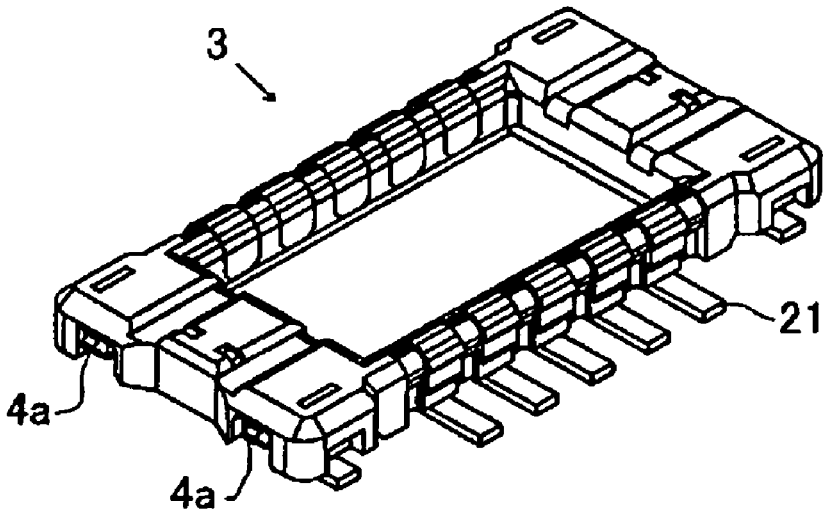
FIG. 2A is a perspective view illustrating the front side of the header.
Figure 2B:
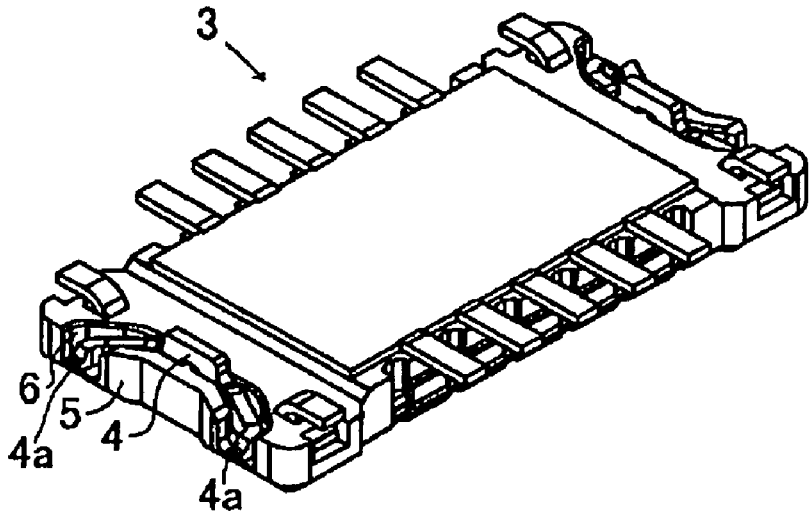
FIG. 2B is a perspective view illustrating the rear side thereof.

One embodiment of the present invention will now be described with reference to the accompanying drawings. Referring to FIG. 1, a connector 1 in accordance with the embodiment of the present invention includes a socket 2 and a header 3 attached to the socket 2. Just like a conventional one, the socket 2 is provided with a plurality of socket contacts (or signal terminals) 12. Similarly, the header 3 is provided with a plurality of header contacts (or signal terminals) 21. If the socket 2 and the header 3 are assembled together, the socket contacts 12 are brought into contact with, and electrically connected to, the header contacts 21.

In the event that the socket 2 and the header 3 are decoupled or loosely coupled, the electrical connection between the socket contacts 12 and the header contacts 21 is destroyed or becomes unstable. The coupling between the socket 2 and the header 3 is reliably kept by the inventive configuration described below. Description will now be made on the configurations of the socket 2 and the header 3 and then the coupling method thereof.

The header 3 will be described first. As shown in FIG. 1, the header 3 has a generally rectangular outward appearance. In two short sides (designated by arrow B) of four sides of the header 3, there are provided locking grooves 6. In other words, the locking grooves 6 are formed by defining recesses on the opposite short sides of the header 3 and providing support walls 5 at the outer sides of the recesses. Each of the locking grooves 6 is opened at the opposite lateral ends of each of the support walls 5.

Figure 3A:
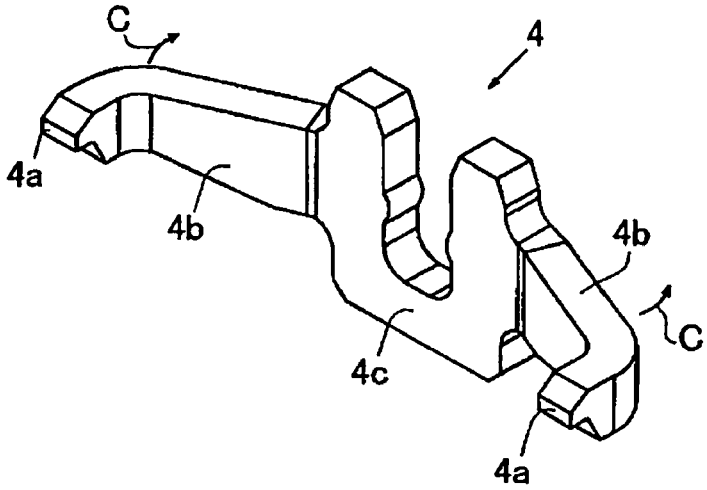
FIG. 3A is a perspective view showing an engaging member provided in the header.
Figure 3B:
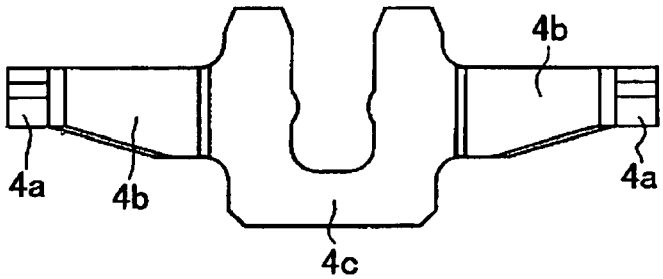
FIG. 3B is a front view of the engaging member.
Figure 3C:
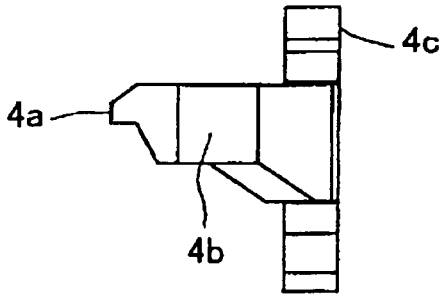
FIG. 3C is a side view of the engaging member.

An arch-shaped engaging member 4 is arranged in each of the locking grooves 6. As illustrated in FIG. 3, the engaging member 4 is provided with a main body 4*c*, a pair of arm portions 4*b* and a pair of protrusion portions 4*a*. The arm portions 4*b* are formed at the opposite lateral sides of the main body 4*c*. The protrusion portions 4*a* are provided at the tip ends of the arm portions 4*b*.

The arm portions 4*b* are inclined forwards as they go toward the tip ends thereof. The protrusion portions 4*a* protrude forwards. If the protrusion portions 4*a* are pressed backwards with the main body 4*c* held immovable, the protrusion portions 4*a* are moved backwards (or retracted) as indicated by arrow C in FIG. 3A. In other words, if the protrusion portions 4*a* are pressed, the engaging member 4 protruding from each of the locking grooves 6 (see FIG. 1) of the header 3 is elastically deformed and pushed into the corresponding locking groove 6.

At this time, the elastic deformation of the engaging member 4 occurs within the plane perpendicular to the direction indicated by arrow A in FIG. 1. This means that the size of the engaging member 4 in the direction indicated by arrow A is not changed before and after its deformation. Unlike the present engaging member 4, the conventional engaging member is deformed in the direction indicated by arrow A, for the reason of which the post-deformation size thereof in the direction indicated by arrow A gets greater than the pre-deformation size. Accordingly, use of the present engaging member 4 makes it possible to reduce the height (or the profile) of the connector 1 by the non-deformation amount in the direction indicated by arrow A.

Figure 5A:
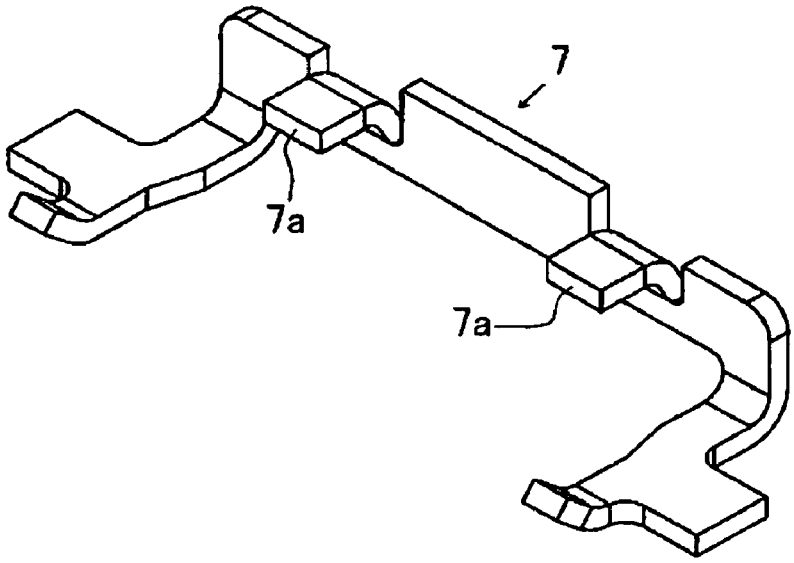
FIG. 5A is a perspective view showing a retainer member provided in the socket.
Figure 5B:
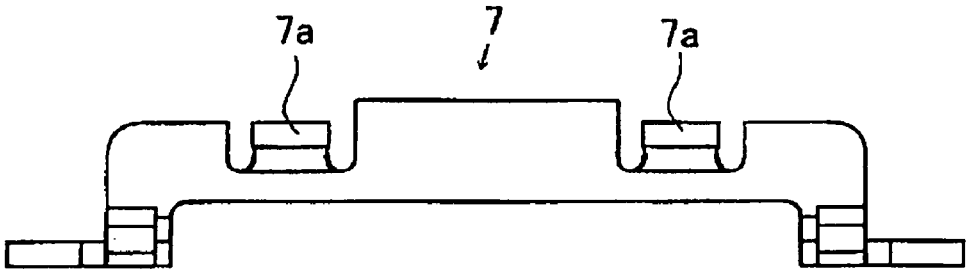
FIG. 5B is a front view of the retainer member.
Figure 5C:
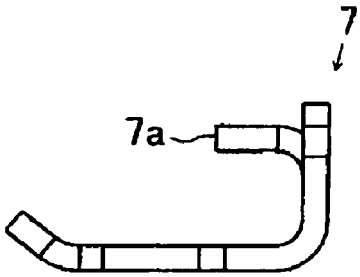
FIG. 5C is a side view of the retainer member.

Next, description will be made on the socket 2. The socket 2 is a little greater in size than the header 3 and has a generally rectangular shape. Retainer members 7 are fixed to the opposite short sides of the socket 2. The retainer members 7 are arranged in such positions that they can engage with the engaging members 4 of the header 3 when the header 3 is attached to the socket 2. As shown in FIG. 5A, each of the retainer members 7 is provided with two contact portions 7*a*.

Figure 4A:
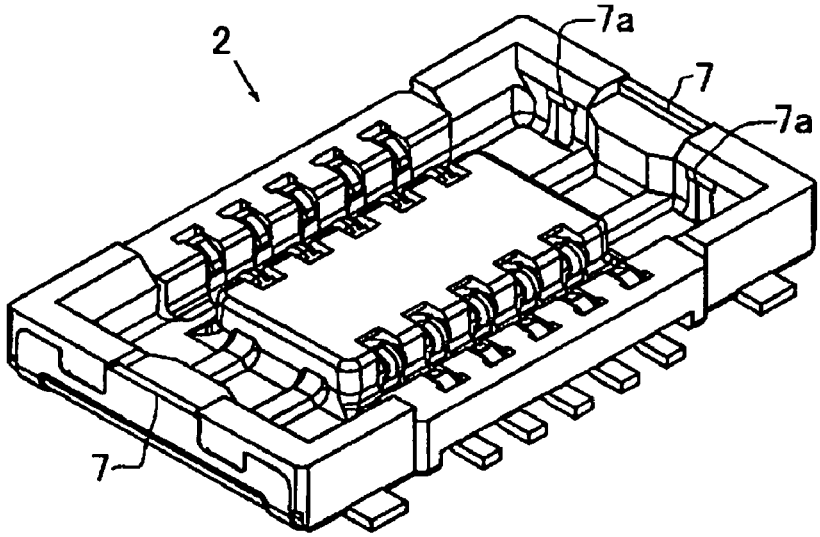
FIG. 4A is a perspective view illustrating the front side of the socket.
Figure 4B:
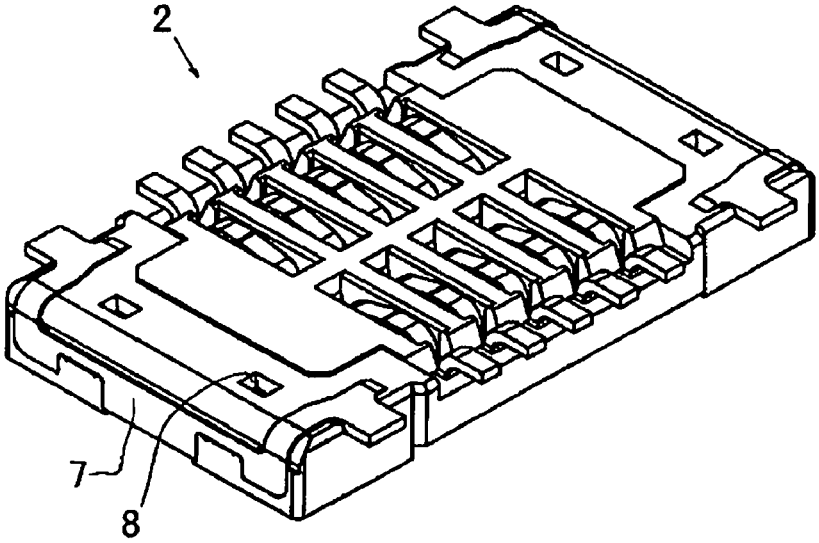
FIG. 4B is a perspective view illustrating the rear side thereof.

Referring to FIG. 4B, holes 8 are formed on the rear surface of the socket 2. The holes 8 are arranged in such positions that they are located near the contact portions 7*a* of the retainer members 7 when the retainer members 7 are attached to the socket 2.

Figure 6A:
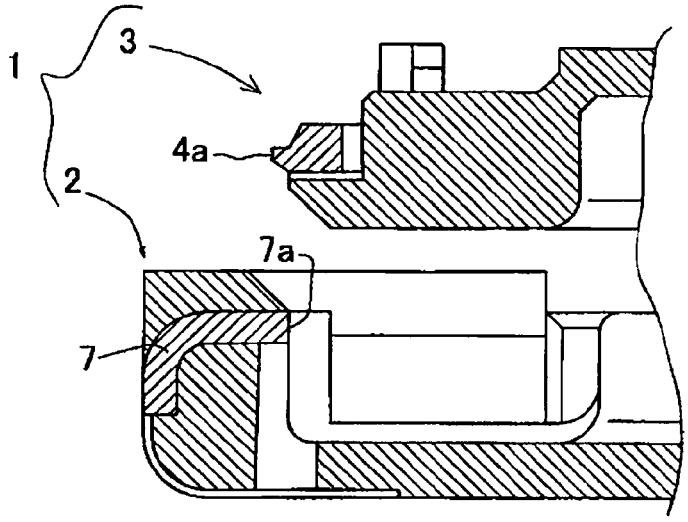
FIG. 6A is a section view illustrating an engagement process of the engaging member and the retainer member 7 in which the header is placed near the socket.

Next, a method of coupling the socket 2 and the header together will be described with reference to FIGS. 6A through 6C. If the socket 2 and the header 3 are spaced apart from each other as shown in FIG. 6A, the protrusion portions 4*a* of the engaging member 4 of the header 3 protrude forwards (in the left direction in FIG. 6A).

Figure 6B:
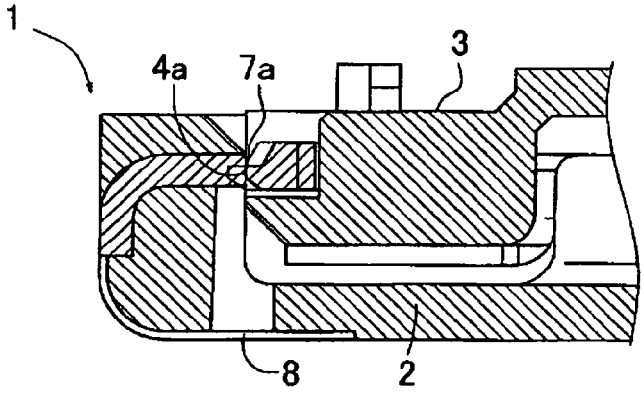
FIG. 6B is a section view illustrating an engagement process of the engaging member and the retainer member in which the engaging member is being engaged with the retainer member in the course of attaching the header to the socket.

In the course of mounting the header 3 to the socket 2 as illustrated in FIG. 6B, the protrusion portions 4*a* of the engaging member 4 of the header 3 come into contact with the contact portions 7*a* of the retainer member 7 of the socket 2 and are moved backwards or retracted (in the right direction in FIG. 6B).

Figure 6C:
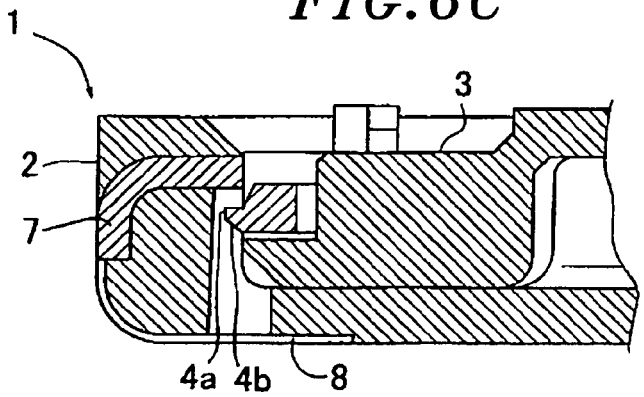
FIG. 6C is a section view illustrating an engagement process of the engaging member and the retainer member in which the engaging member has been completely engaged with the retainer member.
Figure 7:
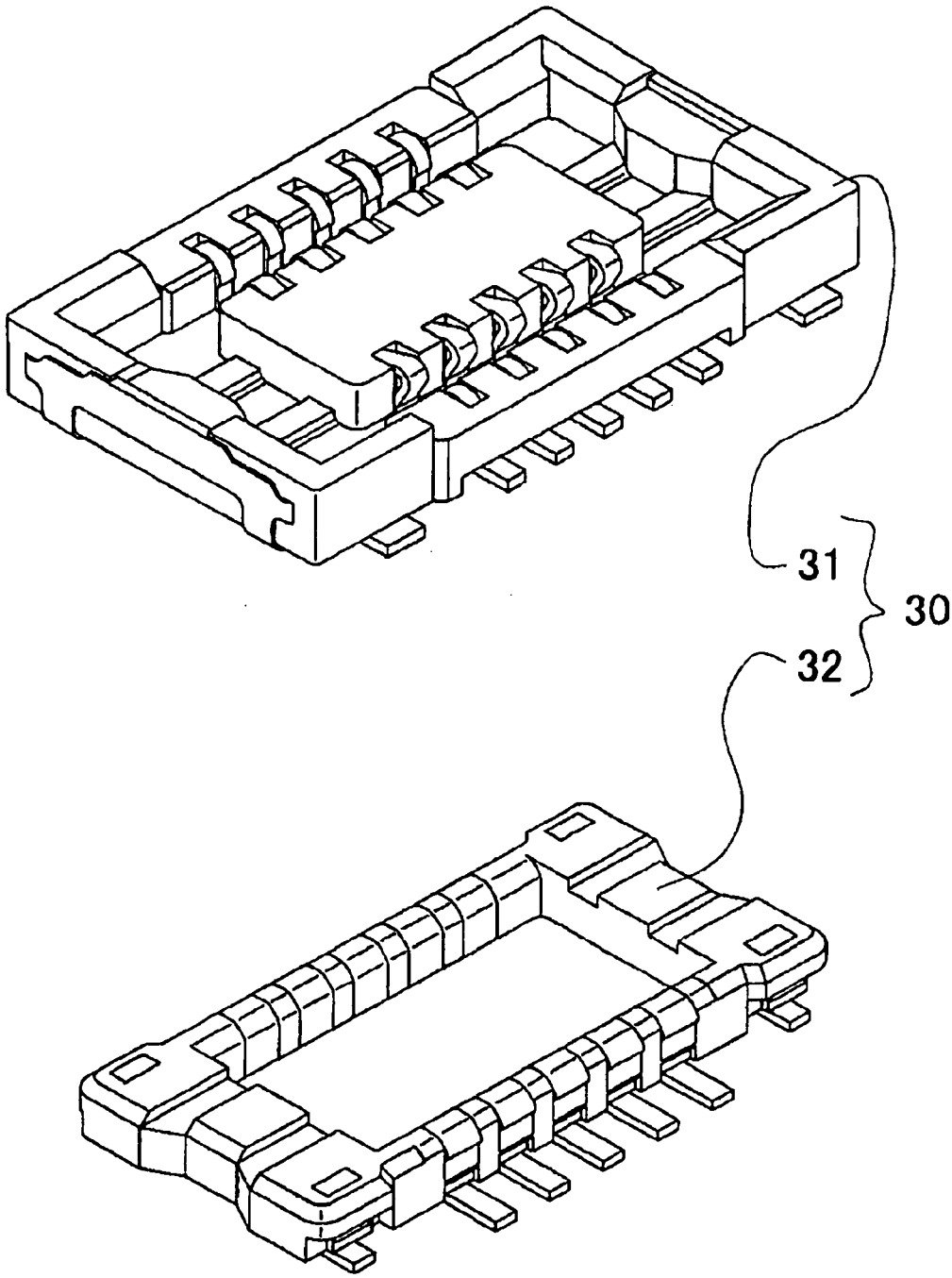
FIG. 7 (PRIOR ART)
FIG. 7 is a perspective view showing a header and a socket of a conventional connector.

If the header 3 is pressed against the socket 2 as illustrated in FIG. 6C, the protrusion portions 4*a* of the engaging member 4 come out of contact with the contact portions 7*a* of the retainer member 7 and move forwards (in the left direction in FIG. 6C). In the state illustrated in FIG. 6C, the protrusion portions 4*a* of the engaging member 4 engage with the contact portions 7*a* of the retainer member 7, thereby eliminating the possibility that the header 3 is inadvertently removed from the socket 2.

In case where there is a need to remove the header 3 from the socket 2, a rod-like member (not shown) is inserted into each of the hole 8 of the socket 2 to press the protrusion portion 4*a*. A slanting portion 4*b* is formed on the lower surface of each of the protrusion portions 4*a* as shown in FIG. 6C. The tip end of the rod-like member inserted into the hole 8 is pressed against and slid along the slanting portion 4*b*. Thus, the protrusion portions 4*a* are smoothly moved backwards in the right direction.

Although the contact portions 7*a* of the retainer member 7 are spaced apart from the protrusion portions 4*a* of the engaging member 4 in FIG. 6C, the header contacts 21 are immoderately pressed against the socket contacts 12 at that time. The positions of the socket contacts 12 and the header contacts 21 are set so that they can be accurately brought into contact with each other if the lower surfaces of the contact portions 7*a* make contact with the upper surfaces of the protrusion portions 4*a*. This assures good electric conduction between the socket contacts 12 and the header contacts 21.

While the foregoing description is directed to an example in which the engaging member 4 has two protrusion portions 4*a*, it may be possible to provide the engaging member 4 in the same number as that of the protrusion portions 4*a*. In other words, one engaging member may be provided with one protrusion portion. For example, it may be possible to use two short engaging members whose length is equal to one half or less of the length of the engaging member 4 shown in FIG. 1. In this case, the central portions of the short engaging members are arranged in alignment with the protrusion portions 4*a* shown in FIG. 1. The arch-shaped opposite end portions of the short engaging members are brought into contact with the header 3. The central portions of the short engaging members are formed to protrude toward the contact portions 7*a*. The shape of locking grooves 6 is also changed to meet the shape of the short engaging members.

Although the engaging members 4 and the retainer members 7 are respectively provided to the header 3 and the socket 2 in the aforementioned embodiment, the engaging members 4 and the retainer members 7 may be respectively provided to the socket 2 and the header 3.

While the invention has been shown and described with respect to the embodiments, it will be understood by those skilled in the art that various changes and modifications may be made without departing from the scope of the invention as defined in the following claims.

What is claimed is:

1. A connector comprising a generally rectangular socket and a generally rectangular header couplable with the socket, wherein:

one of the header and the socket is provided with arch-shaped engaging members arranged in opposite short sides thereof, the engaging members being elastically deformable in the longitudinal direction of the header or socket, each of the engaging members includes a protrusion portion protruding from said one of the header and the socket in the longitudinal direction thereof, the other of the header and the socket includes retainer members engageable with the respective protrusion portions of the engaging members, and the engaging members are elastically deformed while mounting the header to the socket, wherein the header or the socket including the retainer members has holes formed on a lower surface thereof opposite to an upper surface on which the header or the socket provided with the engaging members is mounted, each hole being shaped to permit insertion of a rod-like member therethrough, and wherein when the rod-like member is inserted into the hole to press the protrusion portion of each of the engaging members, the protrusion portion is elastically deformed inwards of said one of the header and the socket to release engagement of the protrusion portion and a corresponding retainer member, wherein a slanting portion is formed on a lower surface of the protrusion portion, and when the rod-like member is inserted into the hole, a tip-end of the rod-like member is pressed against and slid along the slanting portion.

2. The connector of claim 1, wherein, while mounting the header to the socket, the protrusion portions of the engaging members are pressed by the retainer members and elastically deformed inwards of the header or socket, after which the protrusion portions are restored to an original state and engaged with the retainer members.

3. A connector comprising a socket, a generally rectangular header couplable with the socket, and a lock mechanism for coupling the socket and the header together, wherein:

the lock mechanism includes: arch-shaped engaging members arranged in opposite short sides of the header, the engaging members being extendible and retractable in a width direction of the header, the engaging members provided with protrusion portions whose protrusion amount from the header is increased when the engaging members are retracted but decreased when the engaging members are extended; and retainer members provided in the socket and engageable with the respective protrusion portions of the engaging members, wherein the socket has holes formed on a lower surface thereof opposite to an upper surface on which the header is mounted, each hole of the socket being shaped to permit insertion of a rod-like member therethrough, and wherein the protrusion amount of each of the engaging members from the header are changed to release engagement of the protrusion portion of each of the engaging member and a corresponding retainer member, when the rod-like member is inserted into the hole, wherein a slanting portion is formed on a lower surface of the protrusion portion, and when the rod-like member is inserted into the hole, a tip-end of the rod-like member is pressed against and slid along the slanting portion.

4. The connector of claim 3, wherein, while mounting the header to the socket, each of the protrusion portions is pressed by the corresponding retainer member so that the protrusion amount thereof is decreased, and wherein, when the header is completely coupled with the socket, each of the protrusion portions moves beyond the corresponding retainer member so that the protrusion amount thereof is increased.

5. The connector of claim 1, wherein each of the retainer members includes a contact portion which is contactable with a corresponding protrusion portion, and wherein a lower surface of the contact portion is substantially parallel to an upper surface of the corresponding protrusion portion.

6. The connector of claim 3, wherein each of the retainer members includes a contact portion which is contactable with a corresponding protrusion portion, and wherein a lower surface of the contact portion is substantially parallel to an upper surface of the corresponding protrusion portion.

7. The connector of claim 1, wherein each of the engaging members includes an arm portion, and the protrusion portions are provided at tip ends of the arm portion, and wherein each of the engaging members includes two protrusion portions.

8. The connector of claim 3, wherein each of the engaging members includes an arm portion, and the protrusion portions are provided at tip ends of the arm portion, and wherein each of the engaging members includes two protrusion portions.

9. A connector comprising a generally rectangular socket and a generally rectangular header couplable with the socket, wherein:

one of the header and the socket is provided with arch-shaped engaging members arranged in opposite short sides thereof, the engaging members being elastically deformable in the longitudinal direction of the header or socket, each of the engaging members includes a protrusion portion protruding from said one of the header and the socket in the longitudinal direction thereof, the other of the header and the socket includes retainer members engageable with the respective protrusion portions of the engaging members, and the engaging members are elastically deformed while mounting the header to the socket, wherein the header is released from the socket only when a force is applied to the engaging members in the longitudinal direction, wherein the header or the socket including the retainer members has holes formed on a lower surface thereof opposite to an upper surface on which the header or the socket provided with the engaging members is mounted, each hole being shaped to permit insertion of a rod-like member therethrough, and wherein when the rod-like member is inserted into the hole to press the protrusion portion of each of the engaging members, the protrusion portion is elastically deformed inwards of said one of the header and the socket to release engagement of the protrusion portion and a corresponding retainer member, wherein a slanting portion is formed on a lower surface of the protrusion portion, and when the rod-like member is inserted into the hole, a tip-end of the rod-like member is pressed against and slid along the slanting portion.

10. The connector of claim 9, wherein, while mounting the header to the socket, each of the protrusion portions is pressed by the corresponding retainer member so that the protrusion amount thereof is decreased, and wherein, when the header is completely coupled with the socket, each of the protrusion portions moves beyond the corresponding retainer member so that the protrusion amount thereof is increased.

11. The connector of claim 9, wherein each of the retainer members includes a contact portion which is contactable with a corresponding protrusion portion, and wherein a lower surface of the contact portion is substantially parallel to an upper surface of the corresponding protrusion portion.

12. The connector of claim 9, wherein each of the engaging members includes an arm portion, and the protrusion portions are provided at tip ends of the arm portion, and wherein each of the engaging members includes two protrusion portions.

* * * * *